US005806213A

United States Patent [19]

Doornek et al.

[11] Patent Number: 5,806,213

[45] Date of Patent: Sep. 15, 1998

[54] ROTATABLE SUPPORT WHEELS FOR A SNOWPLOW

[75] Inventors: James R. Doornek, Mequon; Gerald E. Lutzke, Sheboygan, both of Wis.

[73] Assignee: Douglas Dynamics, L.L.C., Milwaukee, Wis.

[21] Appl. No.: 779,730

[22] Filed: Jan. 6, 1997

[51] Int. Cl.[6] ..... E01H 5/04

[52] U.S. Cl. ..... 37/231; 37/236; 37/270

[58] Field of Search ..... 37/231, 232, 233, 37/235, 266, 270, 271; 172/272, 273, 274, 311

[56] References Cited

U.S. PATENT DOCUMENTS

| | | | |
|---|---|---|---|
| 1,964,617 | 6/1934 | Bird | 37/236 X |
| 3,466,766 | 9/1969 | Kahlbacher | 37/270 X |
| 4,905,387 | 3/1990 | Street | 37/270 X |
| 4,962,599 | 10/1990 | Harris | 37/231 X |
| 5,125,174 | 6/1992 | Watson et al. | 37/231 |
| 5,129,170 | 7/1992 | Fussilli | 37/231 |
| 5,329,708 | 7/1994 | Segorski et al. | 37/231 |
| 5,335,923 | 8/1994 | Langenback et al. | 280/79.11 |
| 5,408,765 | 4/1995 | Lozensky | 37/231 |
| 5,485,690 | 1/1996 | MacQueen | 172/240 X |

*Primary Examiner*—Michael J. Carone
*Assistant Examiner*—Robert Pezzuto
*Attorney, Agent, or Firm*—R. J. Bunyard; L. A. Fillnow

[57] ABSTRACT

A snowplow (20) adapted for being attached to or detached from a vehicle (22) having a frame (24). The snowplow includes a mount frame (26) for connection to the vehicle frame, a support frame (32), a lift assembly (38) and a blade assembly. The blade assembly of the invention includes a blade (30), a blade cutting edge (31) and a wheel support assembly (56). The support frame includes a forward end (33) for supporting the blade and a rearward end (36) for connection to the vehicle. When detached from the vehicle as a single unit, the resultant weight on the rearward end of the support frame may be supported on a ground surface (46) by a jack stand (48). The wheel support assembly includes a yoke assembly (60) having a pair of sides (62) for supporting a wheel (57), a biased spring 80 mounted onto a stud (76) for allowing the yoke assembly to rotate from an upward inoperative position to a downward load support position, a handle (64), a support plate (65) and a bracket assembly (90) for mounting the wheel assembly to the snowplow. The wheel assembly is rotatable between the inoperative position and the load supporting position and is in the load supporting position when the snowplow is detached from the vehicle. An advantage of this invention is that nearly all of the weight of the snowplow is supported by the wheel support assembly when the snowplow is detached from the vehicle.

20 Claims, 14 Drawing Sheets

ROTATABLE SUPPORT WHEELS FOR A SNOWPLOW

BACKGROUND OF THE INVENTION

This invention relates to a snowplow for mounting to a vehicle. More particularly, this invention relates to a wheel support assembly mounted to the snowplow and movable between an inoperative position and a load supporting position. The wheel support assembly is in the load supporting position when the snowplow is detached from the vehicle.

Plowing of private roads, driveways and parking lots is commonly done by a light or medium duty snowplow mounted to a vehicle such as a pick-up truck. Attachment and detachment of a snowplow to and from a truck has become relatively easy in recent years with advanced state-of-the-art connection means such as disclosed in U.S. Pat. No. 5,125,174, incorporated herein by reference. This patent discloses a snowplow including a blade, a lift frame rotatably connected to the rearward end of a support frame and means for releasably connecting the lift frame to a vehicle mount frame. When the snowplow is detached from the vehicle, the snowplow is removed as single unit with only the inconspicuous mount frame remaining connected to the underside of the vehicle. The snowplow remains in a storage area until needed.

Even though snowplow removal from a vehicle has become relatively easy, maneuvering the snowplow by an operator within the storage area after being detached from the vehicle is not an easy task. A snowplow is very heavy and cannot be easily moved by the operator when detached from the vehicle. The operator may wish to move the snowplow around the floor in the storage area during times when the need for plowing snow arises infrequently or when the snowplow is stored during the warm seasons of the year. Snowplow manufacturers and snowplow operators have long sought ways of easing the maneuverability of an unwieldy detached snowplow. For example, U.S. Pat. No. 5,129,170 discloses that wheels may be used for supporting a snowplow thereby assisting in the movement of the snowplow by the operator when detached from a vehicle. A pair of caster wheels are mounted behind the blade at points generally indicated by B and a single caster wheel is mounted to a crossbar at a point generally indicated by A near the rearward end of an A-frame.

U.S. Pat. No. 5,408,765 also relates to supporting the weight of a snowplow by wheels for easier maneuverability when the snowplow is dismounted from a pick-up truck. A snowplow is supported by a pair of wheel assemblies temporarily attached to the bottom of the blade. Immediately prior to removal from the truck, the blade is raised and the wheel assemblies are mounted to the underside of the blade. Each assembly includes clamp-axle-wheel assemblies mounted to an axle. A blade scraping edge is positioned within each of spaced seats in a pair of clamps. When mounting the snowplow onto the truck, the rearward end of the frame must be lifted by a lifting hoist including a chain and an extension spring. After connecting the snowplow to the truck, the support assemblies must be removed from the blade prior to plowing.

U.S. Pat. No. 5,335,923 relates to supporting the weight of a snowplow by a carriage or dolly while the snowplow is detached from a pick-up truck. The dolly includes longitudinal and transverse support beams allowing the dolly to be maneuvered in any direction. A cross bar is mounted upon a jack and levels the snowplow when the blade is supported by a transverse support beam. The snowplow is mounted to the truck by maneuvering the dolly into position in front of and under the truck.

Nevertheless, there remains a need to obviate the requirement for temporarily attaching a support assembly to the bottom of a snowplow blade immediately prior to removing the snowplow from a vehicle. There remains a further need wherein it is not necessary to support a snowplow by a carriage when the snowplow is detached from a vehicle. Finally, there remains a need to provide a snowplow wherein the snowplow not only can be easy to move across a storage area but also can be easy to maneuver in any direction by the smallest of operators when the snowplow is detached from a vehicle and can be easily maneuvered into position for attaching to the vehicle.

SUMMARY OF THE INVENTION

This invention relates to a snowplow adapted for being mounted onto a vehicle for plowing roadways, driveways and the like and capable of being detached from the vehicle during periods when not being used for the plowing of snow.

An object of the invention is to obviate the need for auxiliary equipment that is not an integral part of the snowplow, e.g., a support carriage, for moving the detached snowplow within the storage area. Another object of the invention is to provide means for supporting the snowplow wherein the support means is an integral part of the snowplow. Another object of the invention is to provide a snowplow that can be easily maneuvered into alignment for attachment to the vehicle without requiring the assistance of a second person.

This invention includes a snowplow adapted to be connected and disconnected from a vehicle having a frame. The snowplow includes a blade assembly and a support frame having a forward end and a rearward end. The blade assembly includes a blade and at least one wheel support assembly. The blade is mounted onto the forward end of the support frame and the rearward end of the support frame is for connection to the vehicle frame. The wheel support assembly is mounted to the snowplow behind the blade and is rotatable between an upward inoperative position and a downward load supporting position.

Another feature of the invention is for the aforesaid wheel assembly to include a yoke assembly rotatably mounted to a bracket assembly.

Another feature of the invention is for the aforesaid bracket assembly to include means for releasing the yoke assembly from the upward position to the downward position.

Another feature of the invention is for the aforesaid bracket assembly to include a latching button for locking the yoke assembly.

Another feature of the invention is for the aforesaid blade assembly to include a pair of spaced wheel support assemblies, one of the wheel support assemblies affixed near one of the outboard ends of the blade and the other of the wheel support assemblies affixed near the other outboard end of the blade.

Another feature of the invention is for the aforesaid rearward end of the support frame to include a ground support means.

An advantage of this invention is that nearly all of the weight of the snowplow has been shifted to the wheel support assembly when the snowplow is detached from a vehicle so that an operator can easily maneuver the snowplow in any direction around a storage area. Other advantages are the wheel support assembly is compact in design, adds minimal cost to the snowplow, does not interfere with the plowing operation, may be permanently attached to the snowplow and not requiring a support carriage for maneuvering the snowplow when the snowplow is detached from the vehicle.

The above and other objects, features and advantages of the invention will become apparent upon consideration of the detailed description and appended drawings.

DETAILED DESCRIPTION OF THE PREFERRED EMBODIMENT

Figure 1:
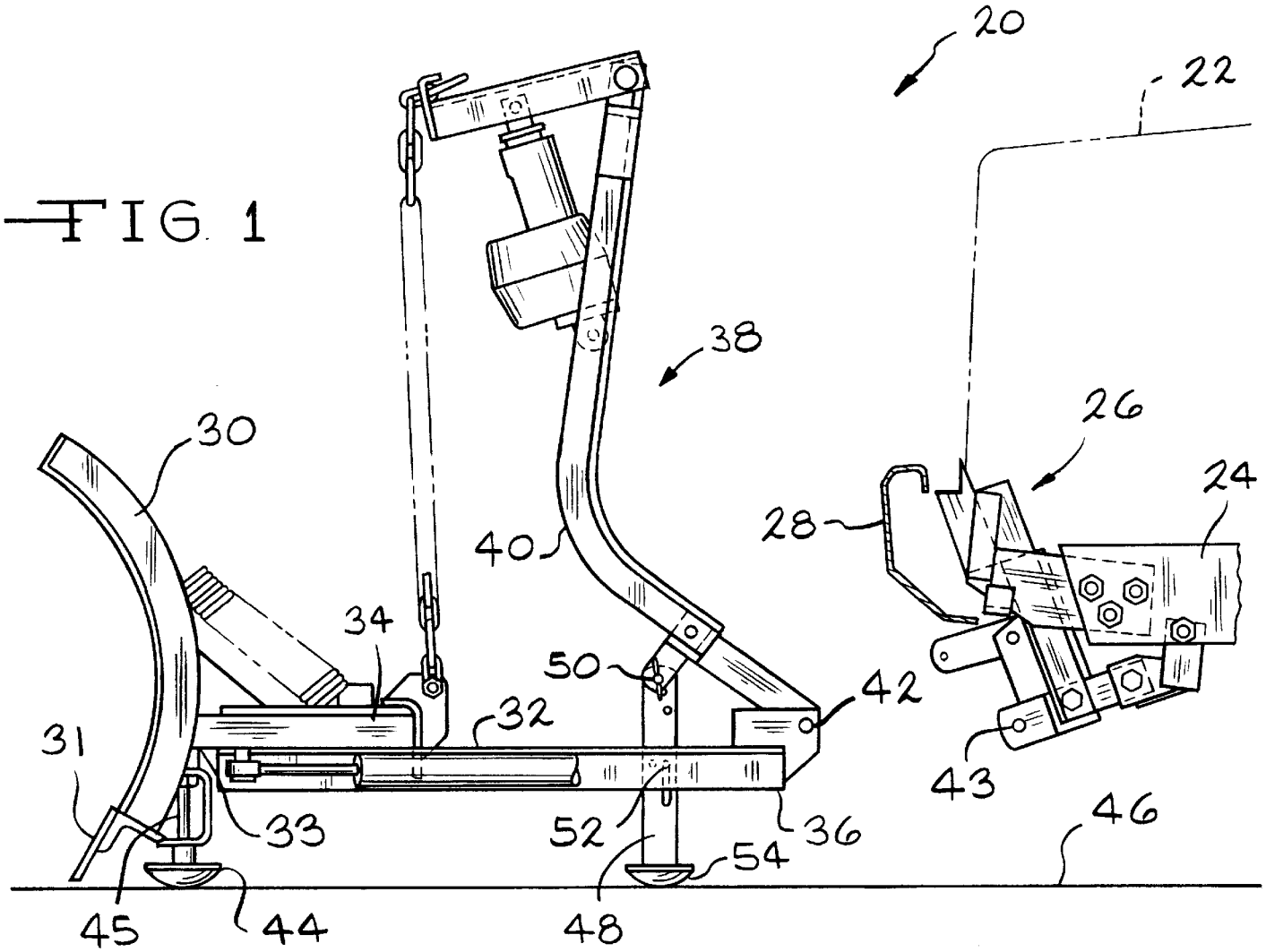
FIG. 1 is a side elevation view of a conventional detachable snowplow.

Referring to FIG. 1, reference numeral 20 illustrates a conventional snowplow adapted for being attached to and detached from a vehicle 22 such as a pick-up truck having a longitudinally extending frame 24 and a front bumper 28. The snowplow illustrated in FIG. 1 is detached from the vehicle and is sitting on a ground or floor surface such as in a maintenance building or garage during periods when highways, parking areas, driveways and the like are snow free. The snowplow includes a mount frame 26 for connection to vehicle frame 24 at a point behind bumper 28, a support frame 32 such as an A-frame, a lift assembly 38 and a blade assembly including a blade 30 having a blade cutting edge 31. Support frame 32 includes a forward end 33 such as a quadrant 34 for supporting blade 30 and a rearward end 36 for connection to the vehicle frame. Lift assembly 38 includes a goose neck type lift arm 40 whose lower end is pivotally connected at a pivot 42 to a pivot 43 on mount frame 26 to the vehicle. The blade may be provided with a pair of spaced skid pads or wear shoes 44 each mounted at the bottom of a shaft 45 with the skid pads affixed near opposite outboard ends of the blade. The skid pads may be used to prevent damage or digging into the roadway surface by the cutting edge when plowing uneven surfaces or unfrozen dirt or grassy areas. When detached from the vehicle as a single unit, the resultant weight on the rearward end of the snowplow support frame is supported on a surface 46 by means preferably connected to the support frame such as a jack stand 48 having a foot 54. The jack stand is pivotally connected to lift arm 40 at connection 50 and pivotally supported by support frame 32 at a pivot point 52 positioned a short distance forward of the rearward end of the support frame. Snowplow 20 is completely detached from vehicle 22 with only inconspicuous mount frame 26 remaining connected to the vehicle.

Figure 2:
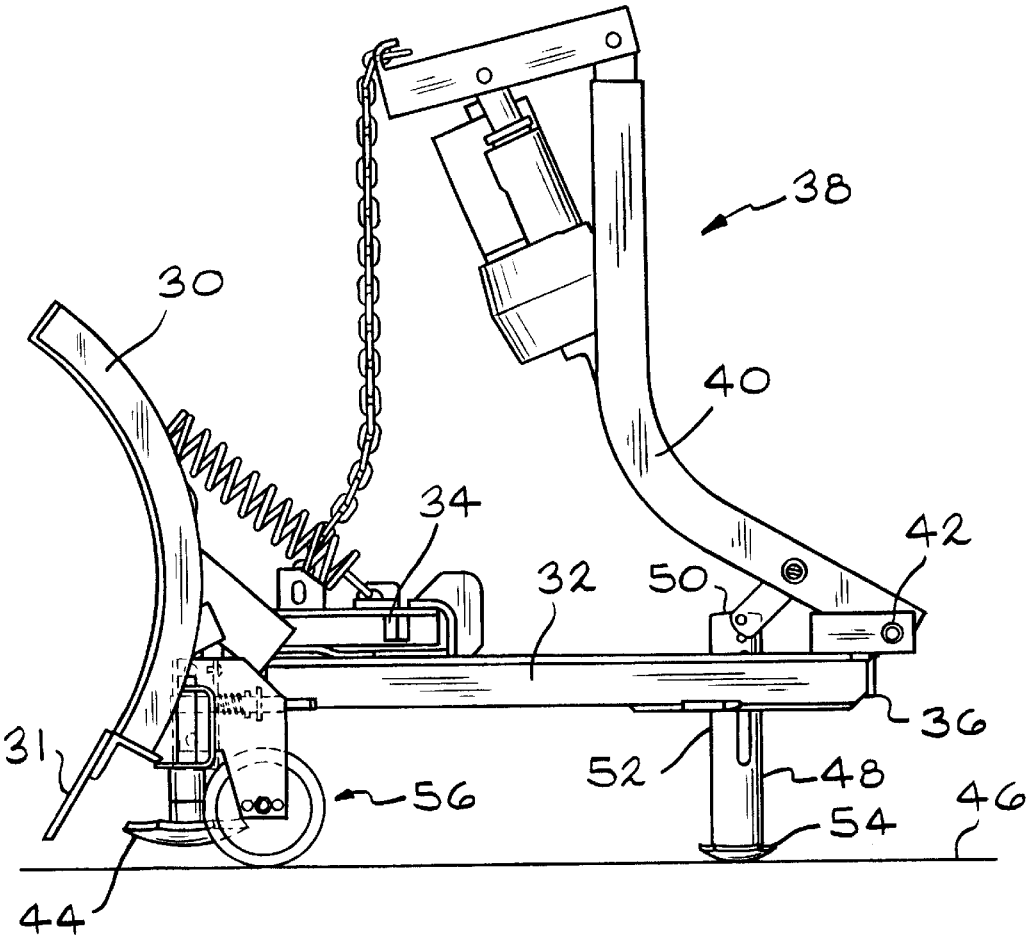
FIG. 2 is a view similar to the snowplow of FIG. 1 but including one embodiment of the invention.

FIG. 2 illustrates a snowplow of the invention. In this embodiment, a blade assembly includes a blade 30 having a cutting edge 31 and at least one support assembly 56. The wheel support assembly is mounted to the snowplow at a position behind the rear of cutting edge 31 but forward of a rearward end 36 of support frame 32. Like the conventional snowplow of FIG. 1, the invention of FIG. 2 also includes a ground support means. The support means of the invention does not have to be connected to the support frame. Jack stand foot 54 of the invention preferably is made from a tough, low friction synthetic material such as nylon.

Figure 3:
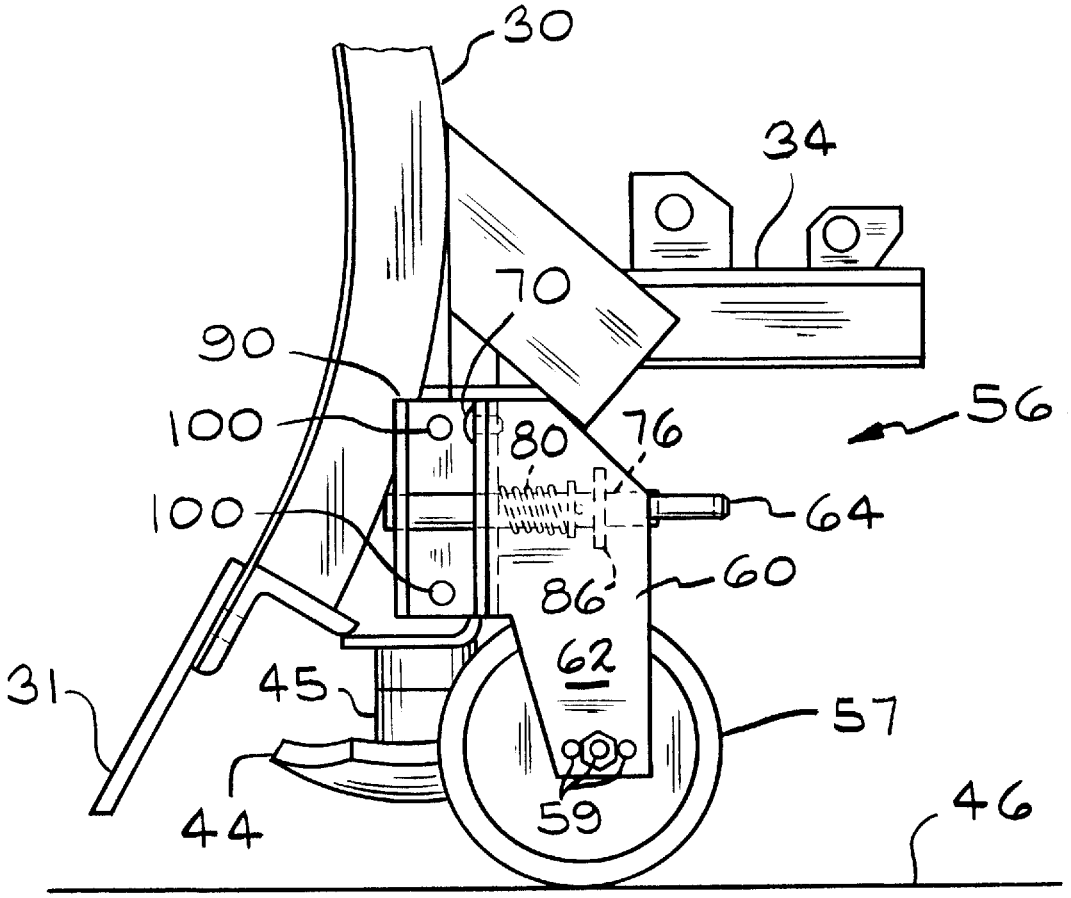
FIG. 3 is an enlarged view of the snowplow of FIG. 2 with parts of the snowplow removed illustrating the wheel of a wheel support assembly in a downward or load support position.

FIG. 3 illustrates a side view with wheel support assembly 56 being in the downward or load supporting position when the snowplow is detached from the vehicle.

Figure 4:
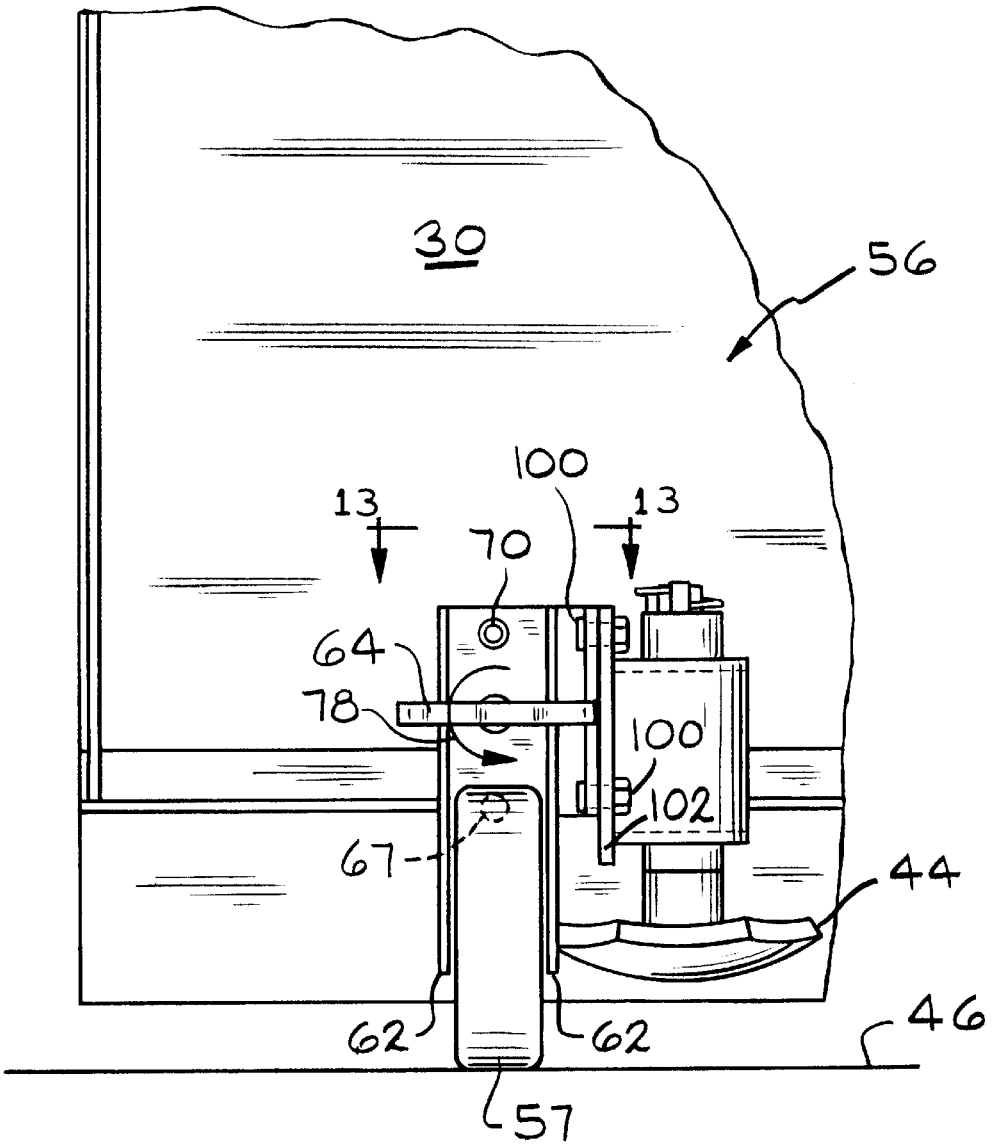
FIG. 4 is a rear view of the snowplow and the wheel support assembly of FIG. 3.

FIG. 4 illustrates a rear view of the embodiment of FIG. 3 with wheel support assembly 56 in the downward or load supporting position.

Figure 5:
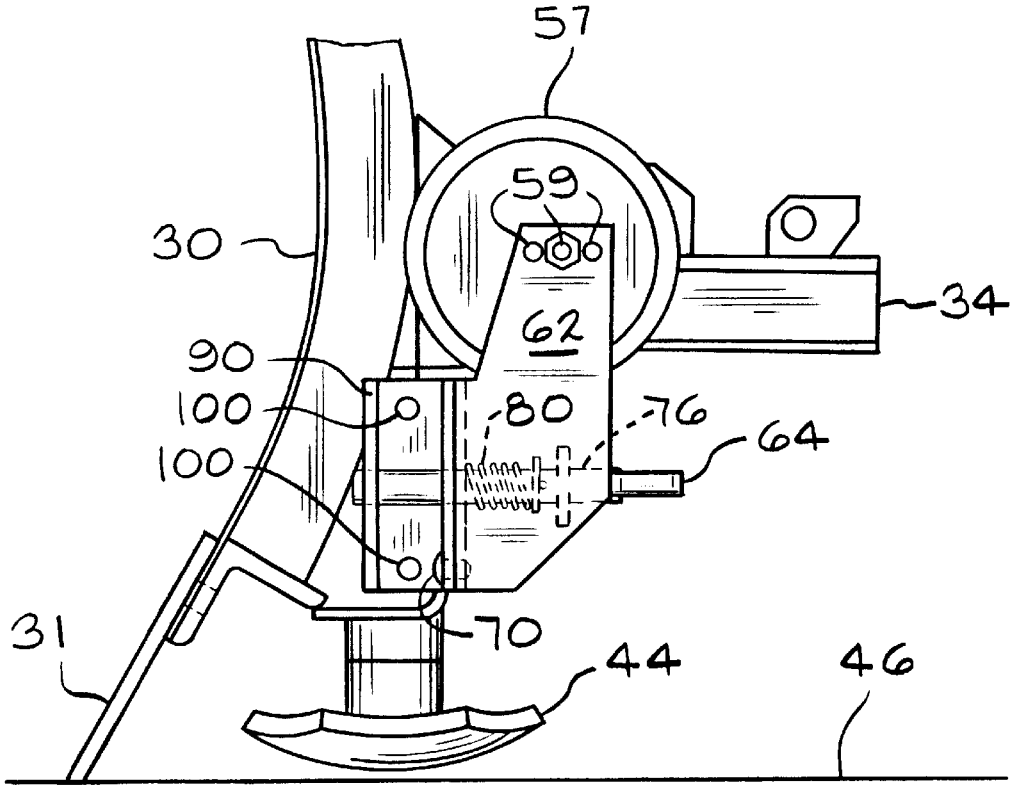
FIG. 5 is a view similar to FIG. 3 illustrating the wheel support assembly in an upward or inoperative position.
Figure 6:
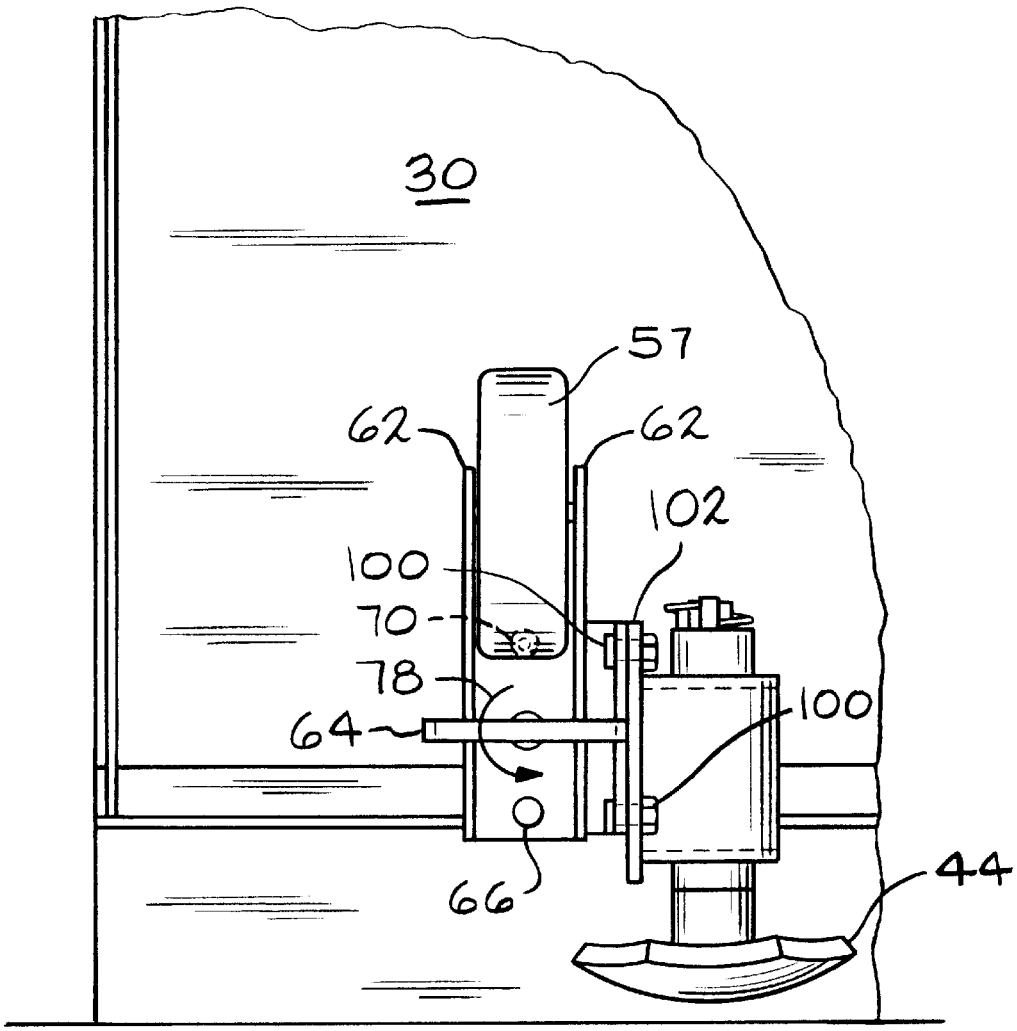
FIG. 6 is a rear view of the snowplow of FIG. 5.
Figure 8:
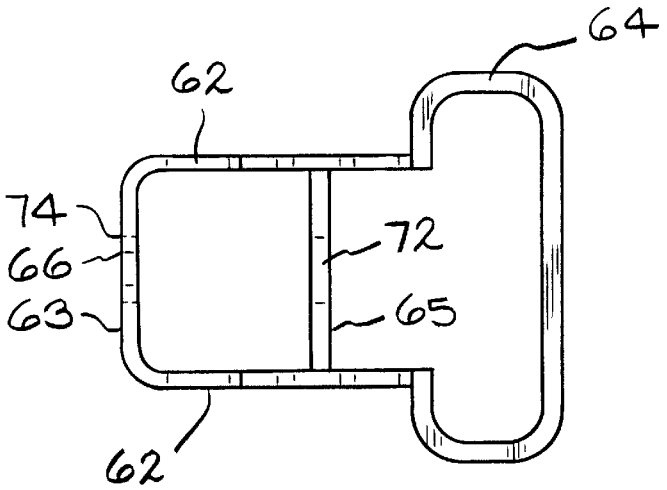
FIG. 8 is a top view of the yoke assembly of FIG. 7.
Figure 7:
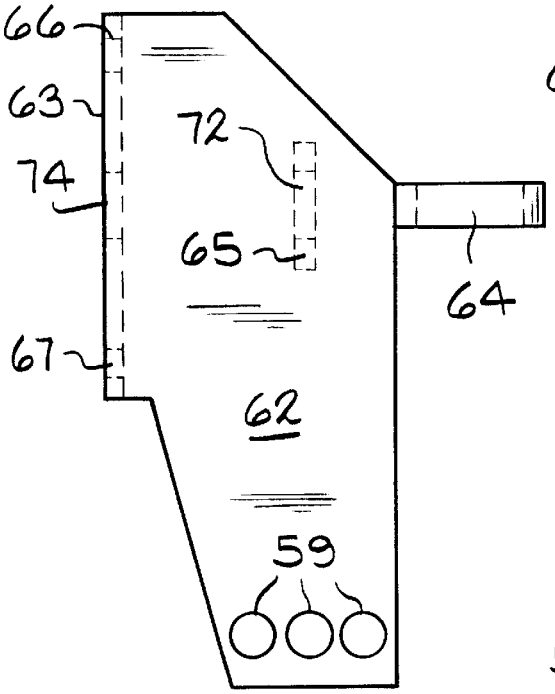
FIG. 7 is a side view of a yoke assembly of FIG. 3.
Figure 9:
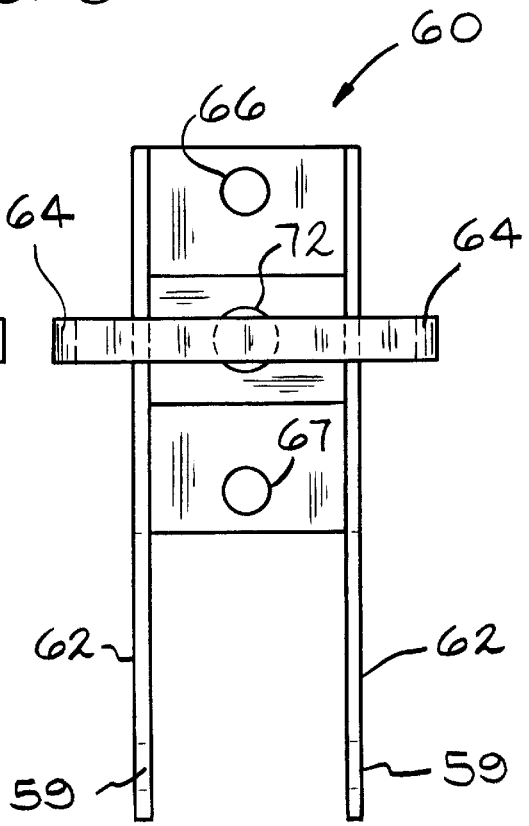
FIG. 9 is a rear view of the yoke assembly of FIG. 7.

FIGS. 5 and 6 correspond to FIGS. 3 and 4 respectively except wheel assembly 56 is in the upward or inoperative position when the snowplow is attached to the vehicle for plowing of snow.

If the blade assembly of the invention includes only one wheel support assembly, the wheel support assembly would be positioned along the center line of the snowplow. Preferably, the blade assembly of the invention is provided with a pair of wheel support assemblies 56 mounted with one of the wheel support assemblies affixed near one of the outboard ends of the blade and the other of the wheel support assemblies affixed near the other outboard end of the blade.

FIGS. 7–12 illustrate details of the wheel support assembly. Wheel support assembly 56 includes a yoke assembly 60 illustrated in FIGS. 7–9 for supporting a wheel 57 (FIG. 3) and a bracket assembly 90 illustrated in FIGS. 10–12. The yoke assembly is mounted to the bracket assembly for rotation and includes a pair of juxtaposed sides 62, an intermediate side 63, a handle 64 and an intermediate support plate 65. Wheel 57 is mounted onto a shaft supported by a hole 59 between sides 62. In the embodiment illustrated, there are three holes 59 for achieving final adjustment of the wheel position. Wheel 57 supports most of the weight of the snowplow when in the downward load supporting position when the snowplow is detached form the vehicle. Side 63 has an upper opening 66, a lower opening 67 and an intermediate opening 74. Support plate 65 includes an opening 72 aligned with opening 74. Openings 72 and 74 receive a stud for allowing yoke assembly 60 to rotate as indicated by an arrow 78 (FIGS. 4 and 6) from the downward or load supporting position to the upward or inoperative position.

Figure 11:
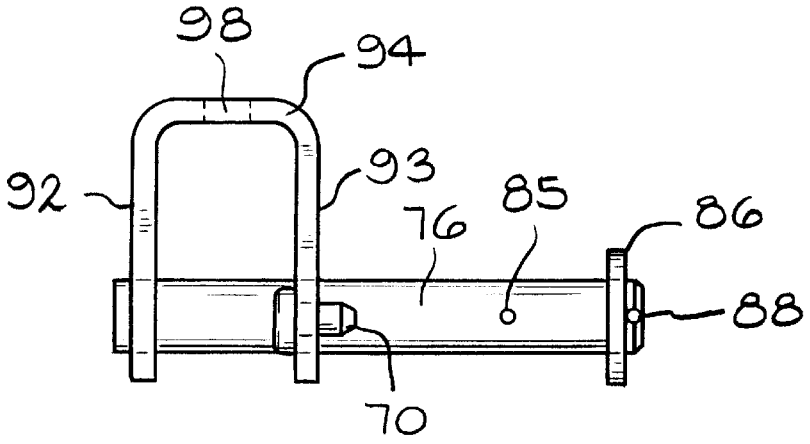
FIG. 11 is a top view of the bracket assembly of FIG. 10 with the spring removed.
Figures 10, 12:
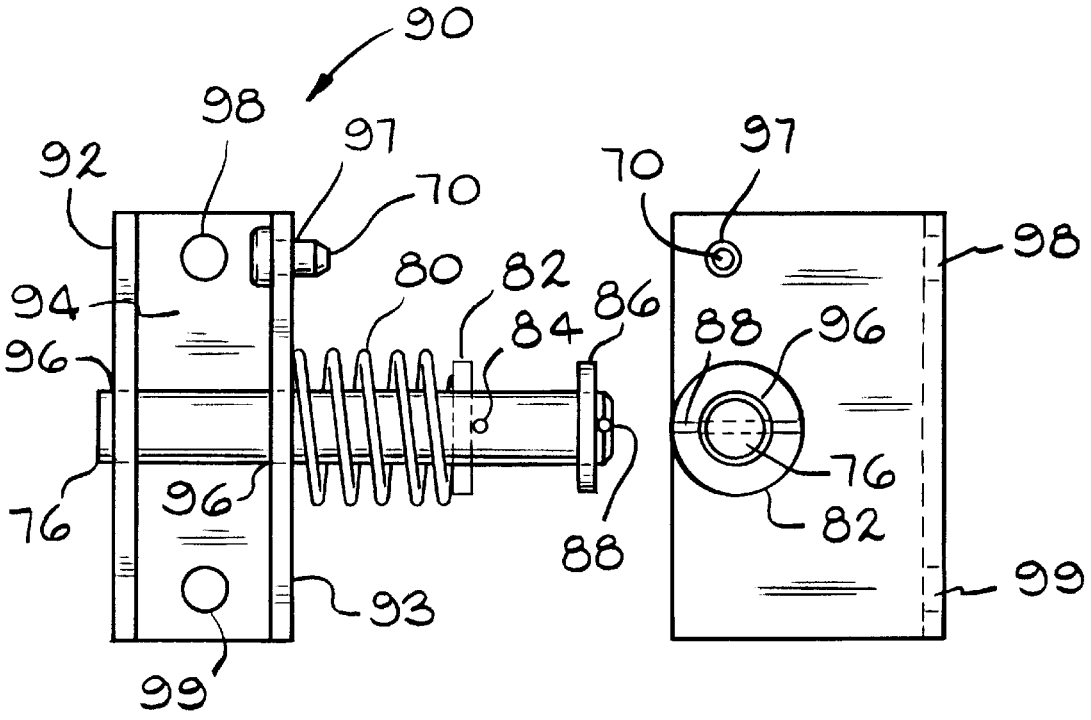
FIG. 10 is a side view of a bracket assembly illustrated in FIG. 3.
FIG. 12 is a rear view of the bracket assembly of FIG. 10.

FIGS. 10–12 illustrate an embodiment of bracket assembly 90 including means for rotationally supporting yoke assembly 60. Bracket assembly 90 includes a pair of juxtaposed side legs 92 and 93, an end leg 94 and means for releasing yoke assembly 60. Legs 92 and 93 each include an aligned opening 96 for receiving rotational support means such a stud 76 with the stud welded to legs 92 and 93. Leg 93 also includes an opening 97 for receiving a latch button 70. Latch button 70 also is welded to leg 93. Leg 94 includes an upper bolt opening 98 and a lower bolt opening 99.

Figure 13:
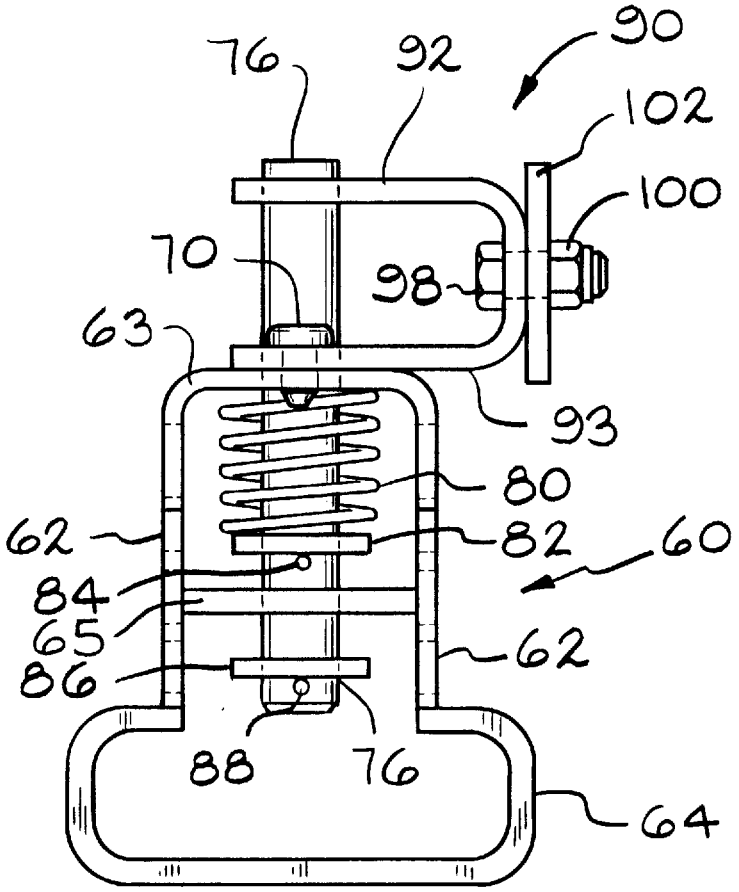
FIG. 13 is a section view taken along line 13—13 of FIG. 4 of the yoke assembly and bracket assembly.

Yoke assembly 60 is mounted for rotation to bracket assembly 90 when stud 76 is received by opening 74 of intermediate side 63 and opening 72 of support plate 65. Positive connection is completed when a biased spring 80 is mounted onto stud 76 and the spring is tightly urged against side 63 by a washer 82 and a retainer 84 as illustrated in FIG. 13. When wheel support assembly 56 is in the downward position, the yoke assembly is securely locked when latch button 70 is received into opening 66 (FIG. 4) in intermediate side 63 of yoke assembly 60. When wheel support assembly 56 is in the up position, the yoke assembly is securely locked when latch button 70 is received into opening 67 (FIG. 6) in intermediate side 63 of yoke assembly 60. Stud 76 may include another washer 86 and a retainer 88. Washer 86 and a retainer 88 limit the travel of yoke assembly 60 by contacting support plate 65. This provides a positive stop so that yoke assembly 60 need not travel excessively in compressing the spring. Washer 86 is positioned so that latch button 70 clears opening 66 and 67 first. For clarity, spring 80, washer 82 and retainer 84 are removed from stud 76 in the top view of FIG. 11.

FIG. 13 illustrates an embodiment for connecting the wheel support assembly to the blade assembly. Yoke assembly 60 of wheel support assembly 56 is mounted for rotation to bracket assembly 90 by stud 76. Positive connection is completed when biased spring 80 is mounted onto stud 76 and is tightly urged against side 63 of yoke assembly by washer 82 and retainer 84. This in turn tightly urges side 63 against side 93 of bracket assembly 90. Bracket assembly 90 is connected to a mounting plate 102 by a pair of bolts 100. Plate 102 extends rearwardly from the blade 30 and is structurally connected to the snowplow by being welded to the blade assembly.

Figure 14:
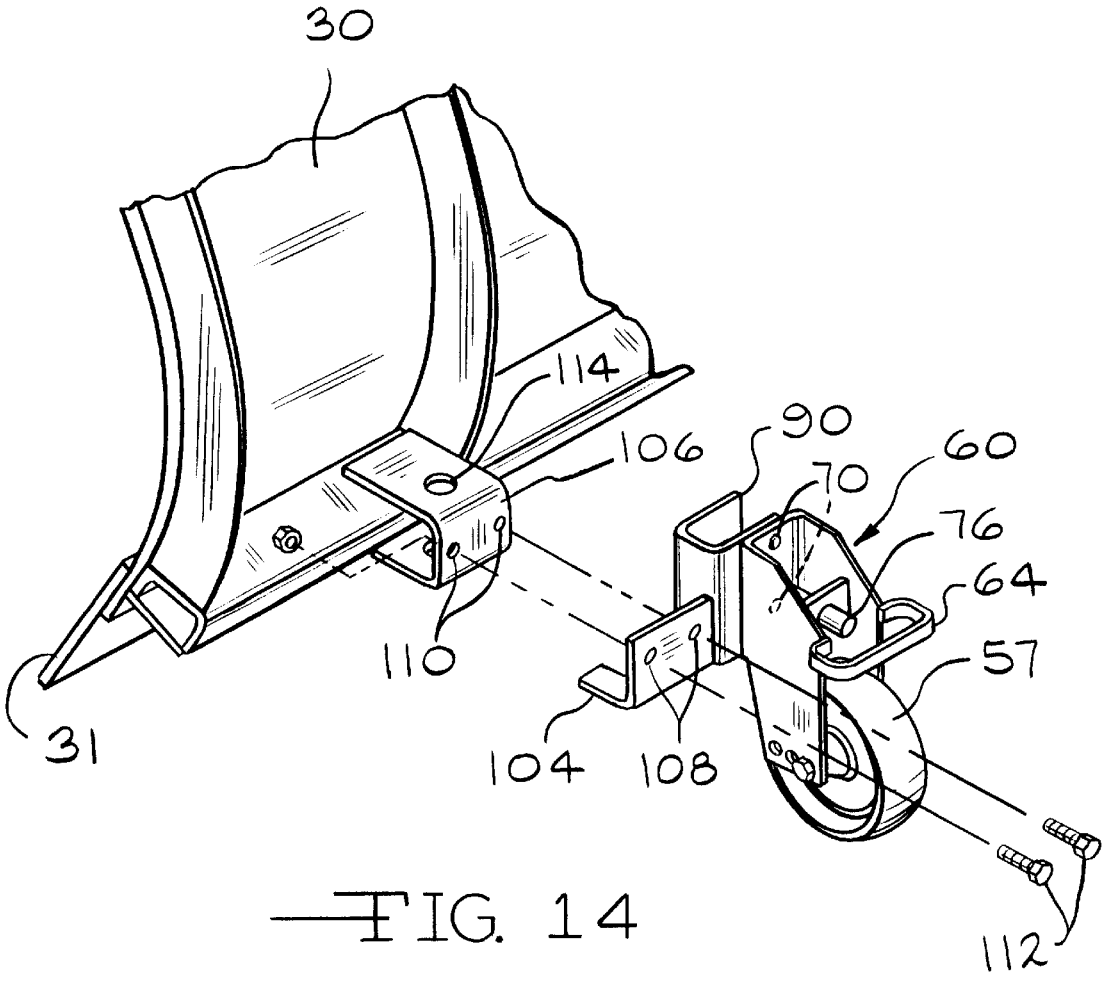
FIG. 14 is a fragmentary perspective view of another embodiment illustrating mounting of the yoke assembly to the snow blade assembly.
Figure 15:
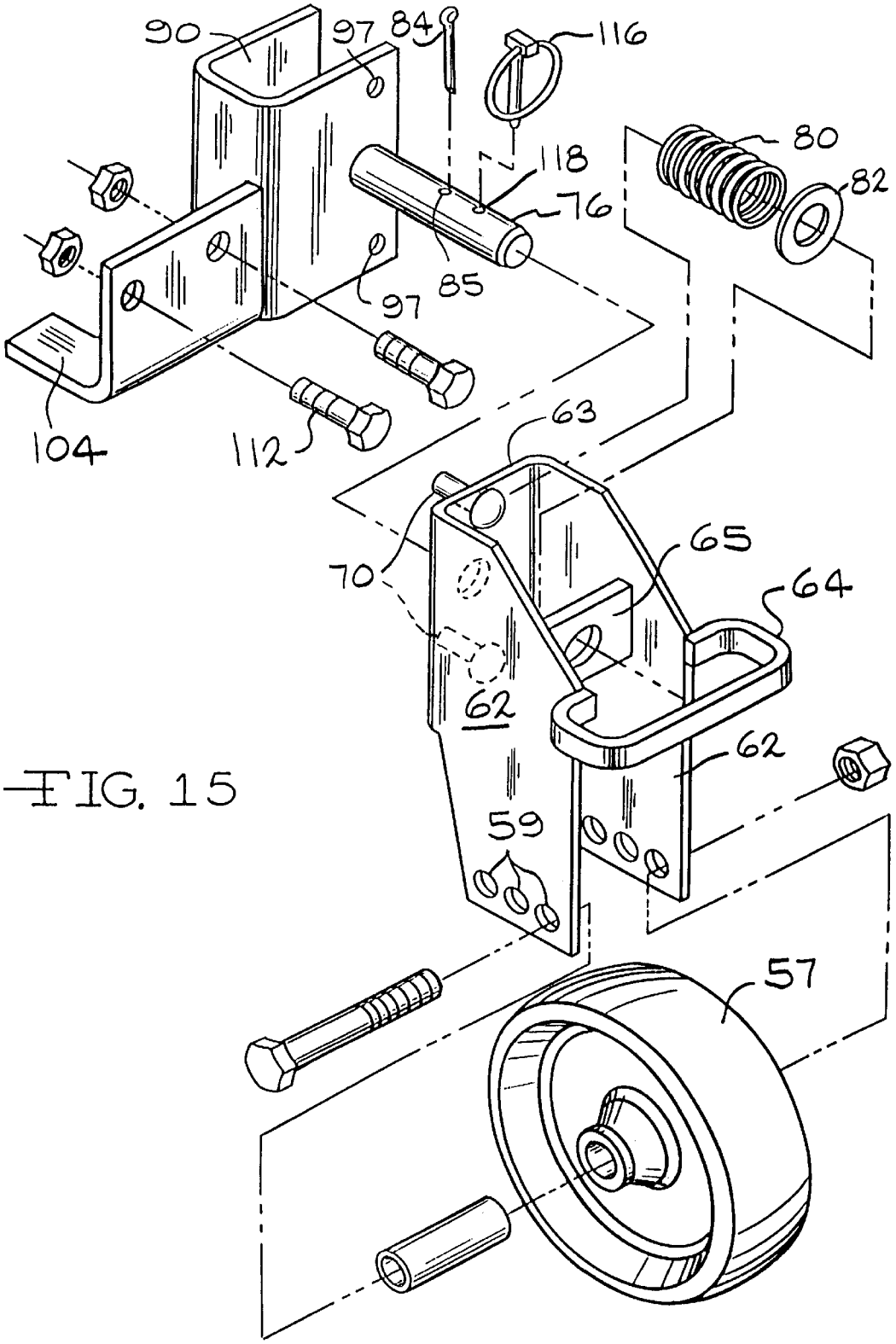
FIG. 15 is a exploded view of the embodiment of FIG. 14 illustrating detail of the yoke assembly.
Figure 16:
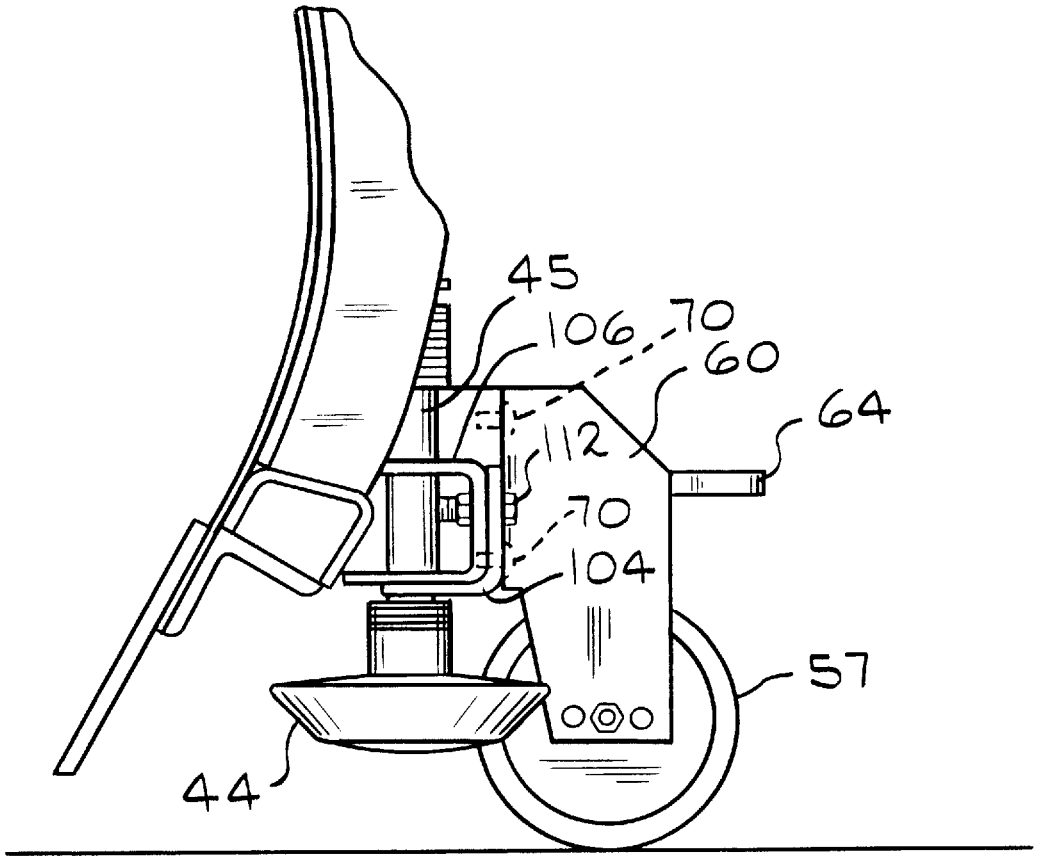
FIG. 16 is a side view of the embodiment of FIG. 14 illustrating the wheel of a wheel support assembly in a downward or load support position.
Figure 17:
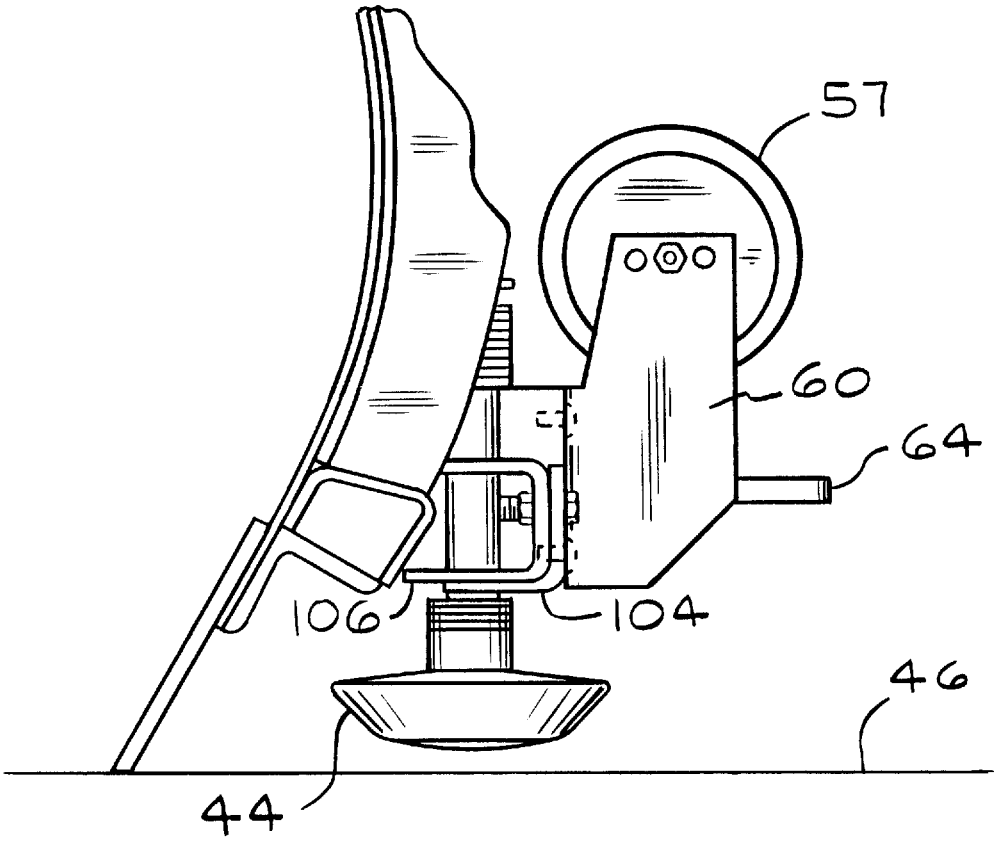
FIG. 17 is a view similar to FIG. 16 illustrating the wheel support assembly in an upward or inoperative position and FIG. 18 is a top view of the embodiment of FIG. 14 with the wheel removed.
Figure 18:
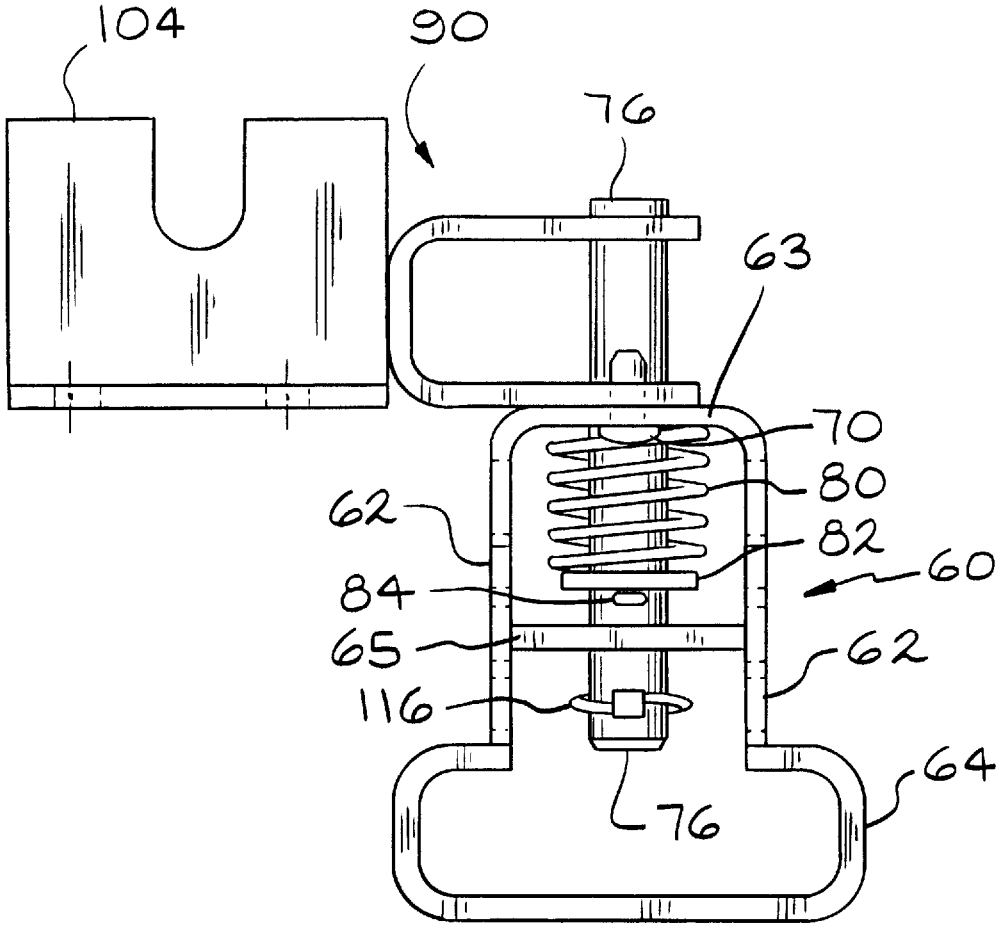

FIG. 14 illustrates another embodiment for mounting yoke assembly 60 of the invention to the blade assembly. FIG. 15 illustrates in detail the embodiment of FIG. 14. FIGS. 16 and 17 are side views of the embodiment in FIG. 14 illustrating the wheel of a support assembly in the load support position and inoperative positions respectively. FIG. 18 is a top view of the embodiment of FIG. 14.

The rotational support means of FIGS. 14–18 are similar to FIGS. 3–12 with the following exceptions. In FIG. 14, plate 102 illustrated in FIG. 13 is replaced with a mounting plate 104 which is welded to bracket assembly 90. Mounting plate 104 is bolted to a shoe bracket 106 which is welded to the blade assembly. Shoe bracket 106 includes a hole 114 and a pair of bolt holes 110 for mating with a pair of corresponding bolt holes 108 in mounting plate 104. Bolt holes 108 and 110 receive bolts 112. Hole 114 in shoe bracket 106 receives shaft 45 of skid plate 44. In FIG. 15, washer 86 and retainer 88 of FIG. 10 are replaced with a linchpin 116. FIG. 15 also illustrates that button 70 of FIGS. 10–12 is removed from bracket assembly 90. In the embodiment of FIGS. 14 and 15, a pair of buttons 70 are included in yoke assembly 60 and are designed to engage in holes 97 of bracket assembly 90. In this embodiment, spring 80 is designed with heavier wire so that its compressed length is longer than the previous embodiment. This precludes the need for washer 86 and retainer 88 since the frame of yoke assembly 60 is limited by the compressed length of spring 80.

In the embodiment of FIGS. 14 and 15, linchpin 116 can be assembled to a hole 118 in stud 76 only when yoke assembly 60 is in the engaged position, with latch buttons 70 fully engaged into holes 97 of support plate 90. Linchpin 116 provides redundant assurance that yoke assembly 60 will not disengage from bracket assembly 90 when the yoke assembly is in the inoperative position. FIG. 18 illustrates when linchpin 116 is installed, plate 65 is in close proximity and just a slight movement of yoke assembly 60 causes plate 65 to immediately contact linchpin 116. This feature prevents unintentional disengagement of yoke assembly 60 which could be caused by severe shock loads which can be encountered through normal use of the snowplow.

Operation of the wheel support assembly of the invention now will be described. When it is desired to remove snowplow 20 from the vehicle, the snowplow will be in the raised position. Wheel support assembly 56 must be rotated from the upper inoperative position to the downward load support position. Linchpin 116 is removed from hole 118 in stud 76 of bracket assembly 90. Additional pressure is applied to spring 80 by pulling on handle 64 in a direction rearwardly away from blade 30. This further compresses spring 80 between side 63 of yoke assembly 60 and washer 82. This pressure is continued until latch buttons 70 are withdrawn from openings 97 in bracket assembly 90. Yoke assembly 60 then is rotated downwardly until latch buttons 70 become aligned with openings 97 in bracket assembly 90. As tension is released from handle 64, latch buttons 70 pass into openings 97 and the wheel assembly becomes locked. Linchpin 116 is reassembled for storage to hole 118 of stud 76. When the snowplow is detached from the vehicle, jack stand 48 then may be rotated into a load support position with most of the weight of the snowplow being be applied to wheels 57.

It will be understood various modifications may be made to the invention without departing from the spirit and scope of it. Therefore, the limits of the invention should be determined from the appended claims.

What is claimed is:

1. For use with a vehicle having a frame, a snowplow, comprising:

a blade assembly and a support frame having a forward end and a rearward ends, the blade assembly including a blade and at least one wheel support assembly, the blade mounted on the forward end of the support frame and the rearward end of the support frame adapted for connection to the vehicle frame, the wheel support assembly rotatably mounted to the snowplow at a position behind the blade, the wheel support assembly being rotatable about a horizontal axis extending in a direction parallel to the direction of travel of vehicle between an upward inoperative position and a downward load supporting position whereby the wheel support assembly is in the upward position when the blade is in a plowing position and the load supporting position when the snowplow is detached from the vehicle.

2. The snowplow of claim 1 wherein the wheel assembly includes a yoke assembly and a bracket assembly, the yoke assembly mounted to the bracket assembly for rotation from the inoperative position to the load supporting position.

3. The snowplow of claim 1 wherein the wheel assembly includes a yoke assembly and a bracket assembly, the yoke assembly mounted to the bracket assembly and including a pair of juxtaposed sides and a wheel supported between the sides, the bracket assembly including means for rotationally supporting the yoke assembly.

4. The snowplow of claim 3 wherein the bracket assembly includes a pair of juxtaposed side legs and an end leg, the rotational support means being a stud, each side leg including an opening for receiving the stud, the end leg including an opening for receiving a bolt.

5. The snowplow of claim 4 wherein the yoke assembly includes an intermediate side between the juxtaposed sides, one of the side legs including a pair of spaced openings for receiving a latch button, the latch button received within one of the openings when the wheel support assembly is in the upward position and the latch button received within the other opening when the wheel assembly is in the load supporting position.

6. The snowplow of claim 4 wherein the yoke assembly includes a support plate for receiving the stud, a biased spring mounted onto the stud for urging the yoke assembly into intimate contact with the b racket assembly.

7. The snowplow of claim 6 wherein the stud includes a washer and a retainer for urging the spring against the intermediate side of the yoke assembly.

8. The snowplow of claim 3 wherein the yoke assembly includes a handle for rotating the wheel assembly.

9. The snowplow of claim 2 wherein the bracket assembly is connected to a mounting plate.

10. The snowplow of claim 9 wherein the mounting plate extends rearwardly of the blade and is connected to the blade assembly.

11. The snowplow of claim 9 wherein the blade assembly includes a shoe bracket, the mounting plate being connected to the shoe bracket.

12. The snowplow of claim 1 wherein the blade assembly includes a pair of spaced wheel support assemblies, one of the wheel support assemblies affixed near an outboard end of the blade and the other of the wheel support assemblies affixed near another outboard end of the blade.

13. The snowplow of claim 3 wherein the yoke assembly includes an intermediate side between the juxtaposed sides, the intermediate side including a pair of spaced latch buttons.

14. The snowplow of claim 1 including a support means connected near the rearward end of the support frame.

15. The snowplow of claim 14 wherein the support means is a rotatable jack stand.

16. The snowplow of claim 1 wherein the wheel support assembly is mounted to the snowplow at a position behind a cutting edge of the blade.

17. The snowplow of claim 1 wherein the wheel support assembly is permanently mounted to the snowplow.

18. For use with a vehicle having a frame, a snowplow, comprising:

a blade assembly and a support frame having a forward end and a rearward end, the blade assembly including a blade and at least one wheel support assembly, the blade mounted on the forward end of the support frame and the rearward end of the support frame adapted for connection to the vehicle frame, the wheel support assembly including a yoke assembly and a bracket assembly, the yoke assembly mounted to the bracket assembly for rotation of the wheel support assembly, each yoke assembly being rotatable about a horizontal axis extending in a direction parallel to the direction of travel of the vehicle between an upward inoperative position and a downward load supporting position whereby the wheel support assembly is in the load supporting position when the snowplow is detached from the vehicle.

19. For use with a vehicle having a frame, a snowplow, comprising:

a blade assembly and a support frame having a forward end and a rearward end, the blade assembly including a blade and a pair of wheel support assemblies, the blade mounted on the forward end of the support frame and the rearward end of the support frame including a support means connected thereto with the support frame adapted for connection to the vehicle frame, and the wheel support assemblies mounted to the snowplow at a position behind a cutting edge of the blade, each wheel support assembly including a yoke assembly and a bracket assembly, the bracket assembly including means for rotationally supporting the yoke assembly each yoke assembly being rotatable about a horizontal axis extending in a direction parallel to the direction of travel of the vehicle between an upward inoperative position and a downward load supporting position whereby the wheel support assemblies are in the load supporting position when the snowplow is detached from the vehicle.

20. For use with a vehicle having a frame, a snowplow, comprising:

a support frame and a blade assembly, the support frame having a forward end and a rearward end, the blade assembly including a blade and a pair of wheel support assemblies, the blade mounted on the forward end of the support frame and the rearward end of the support frame including a support means connected thereto and the support frame adapted for connection to the vehicle frame, and the wheel support assemblies mounted to the snowplow at a position behind a cutting edge of the blade, each wheel support assembly including a yoke assembly and a bracket assembly, the yoke assembly including a pair of juxtaposed sides and a wheel supported between the sides, the bracket assembly including means for rotationally supporting the yoke assembly, the yoke assembly being rotatable about horizontal axis extending in a parallel to the direction of travel of the vehicle between an upward inoperative position and a downward load supporting position, the rotational support means including a spring biased stud for urging the yoke assembly into intimate contact with the bracket assembly whereby the wheel support assemblies are in the load supporting position when the snowplow is detached from the vehicle.

* * * * *